US008794021B2

(12) United States Patent
Hähn et al.

(10) Patent No.: US 8,794,021 B2
(45) Date of Patent: Aug. 5, 2014

(54) REFRIGERATED SHELF CABINET

(75) Inventors: Thomas Hähn, Bundenbach (DE); Markus Schu, Wollstein (DE); Wolfgang Zäpf, Fulda (DE)

(73) Assignee: Carrier Corporation, Farmington, CT (US)

( * ) Notice: Subject to any disclaimer, the term of this patent is extended or adjusted under 35 U.S.C. 154(b) by 1141 days.

(21) Appl. No.: 11/631,561

(22) PCT Filed: Jul. 5, 2005

(86) PCT No.: PCT/EP2005/007259

§ 371 (c)(1), (2), (4) Date: Jan. 14, 2008

(87) PCT Pub. No.: WO2006/002986

PCT Pub. Date: Jan. 12, 2006

(65) Prior Publication Data

US 2008/0236182 A1 Oct. 2, 2008

(30) Foreign Application Priority Data

Jul. 6, 2004 (DE) ..... 10 2004 033 071

(51) Int. Cl.
*A47F 3/04* (2006.01)

(52) U.S. Cl.
USPC ..... 62/255; 62/256

(58) Field of Classification Search
USPC ..... 62/256, 255
See application file for complete search history.

(56) References Cited

U.S. PATENT DOCUMENTS

| | | | | |
|---|---|---|---|---|
| 3,103,796 | A * | 9/1963 | Dickson et al. | 62/234 |
| 3,139,738 | A * | 7/1964 | Jarvis | 62/256 |
| 3,168,818 | A * | 2/1965 | Weber | 62/256 |
| 3,182,466 | A * | 5/1965 | Beckwith | 62/256 |

(Continued)

FOREIGN PATENT DOCUMENTS

| | | |
|---|---|---|
| DE | 201 19 347 | 1/2002 |
| DE | 103 36 672 | 3/2005 |
| DE | 103 38 672 | 3/2005 |
| FR | 2690825 | 11/1993 |

OTHER PUBLICATIONS

Machine Translation of FR 2690825 "Cabinet for fresh produce display", eSpace, all.*

*Primary Examiner* — Allen Flanigan
*Assistant Examiner* — Filip Zec
(74) *Attorney, Agent, or Firm* — Bachman & LaPointe, P.C.

(57) ABSTRACT

A shelve cabinet comprises partially cooled shelves which are open towards the front and wherein the goods compartment is cooled by a cool-air curtain flowing through the at least partially perforated rear wall of the goods compartment into the goods compartment and/or by a cool-air curtain flowing along the goods compartment opening. One or more goods display shelves are located in the goods compartment, the goods display shelves being configured in such a manner that the at last one partial flow of the cool-air curtain is guided across them to the front area of the goods display shelves. The goods display shelves are provided with structure for stabilizing at least one partial flow of the cool-air curtain flowing along the goods compartment opening. The goods display shelves are linked with the rear wall of the goods compartment in an air-tight manner and the structure for stabilizing the cool-air curtain flowing along the goods compartment opening are adapted to deviate the cool-air curtain in the direction of the goods compartment.

25 Claims, 3 Drawing Sheets

(56) References Cited

U.S. PATENT DOCUMENTS 3,218,822 A * 11/1965 Bently et al. ..... 62/256
3,289,432 A * 12/1966 Brennan et al. ..... 62/256
3,827,254 A 8/1974 MacMaster
4,466,254 A * 8/1984 Karashima ..... 62/256
4,938,034 A * 7/1990 Rosanio et al. ..... 62/256
5,357,767 A * 10/1994 Roberts ..... 62/256
6,742,344 B2 * 6/2004 Vormedal ..... 62/89
6,971,247 B2 * 12/2005 Yamazaki et al. ..... 62/255
7,121,104 B2 * 10/2006 Howington et al. ..... 62/256

* cited by examiner 1
2
6
15
15'
3
5
4

7a
3
7b
6
15
8

7a
2
3
13
14
15
8
6

REFRIGERATED SHELF CABINET

BACKGROUND OF THE INVENTION

The invention relates to an at least partially refrigerated shelf cabinet that is open towards the front and in which refrigeration of the goods compartment is effected by means of a cooling air curtain flowing through the at least partially perforated rear wall of the goods compartment into the goods compartment and/or by means of a cooling air curtain flowing along the goods compartment opening, the goods compartment thereof having one or more goods display shelves arranged therein which are designed such that at least a partial flow of the cooling air curtain is passed via the same into the region of the forward front of the goods display shelves, and with the goods display shelves having means for stabilizing at least a partial flow of the cooling air curtain flowing along the goods compartment opening.

The non-prepublished German patent application 103 36 672 reveals a cooling shelf cabinet according to the type concerned. By making reference thereto, the disclosure contents of said patent application in its entirety are incorporated in the disclosure contents of the present application.

Partially refrigerated shelf cabinets that are open towards the front—which in the following will be briefly referred to as refrigerated shelf cabinets—of the type concerned are widely known from the prior art. In accordance with the refrigeration configuration of the same, they serve for refrigerating a large variety of products both in the so-called plus temperature range and in the so-called minus temperature range. In doing so, the cooling air produced within the refrigerated shelf cabinet, which is necessary for refrigeration of the goods on display, is passed in undirectional manner into the goods compartment through the at least partially perforated back wall of the goods compartment, while the cooling air curtain flowing along the goods compartment opening provides for separation of the refrigerated goods compartment from the warmer surroundings (air).

The cooling air curtain flowing along the goods compartment opening is constituted by one air curtain only or—with corresponding higher technical expenditure—by two or more cooling air curtains flowing in parallel.

Furthermore, there are known refrigerated shelf cabinets of the type concerned, in which the goods compartment openings can be closed by means of folding and/or sliding doors. However, in comparison with refrigerated shelf cabinets without doors, such refrigerated shelf cabinets have the disadvantage that access to the goods on display therein is possible only after opening of a door. It has been found that the sales figures are higher with "open" refrigerated shelf cabinets than with "closed" refrigerated shelf cabinets.

In the most recent past, purchasers of refrigerated shelf cabinets of the type concerned demand an as uniform as possible distribution of the cooling air within the refrigerated shelf cabinet or the goods compartment. The temperature spread between cold and warm goods is to be no higher than 7.2 K with an average temperature of the goods of 3.3° C. at maximum. The temperature range of the goods is to be between 0 and 7.2° C. Furthermore, refrigerated shelf cabinets of the type concerned must be capable of refrigerating goods introduced from ambient temperature to a temperature in the range from 0 to 7.2° C. within a period of 16 hours at most, with the average temperature of the goods being allowed to be 3.3° C. at most.

It has turned out that these requirements cannot be fulfilled with conventional refrigerated shelf cabinets with a goods volume of more than 250 liters and with goods compartments that cannot be closed by means of doors and/or rolling night blinds.

It is the object of the invention to make available a refrigerated shelf cabinet of the type concerned, which is capable of fulfilling the afore-mentioned requirements.

SUMMARY OF THE INVENTION

To this end, there is suggested a refrigerated shelf cabinet which is characterized in that a) the goods display shelves are joined to the rear wall of the goods compartment in airtight fashion, and b) the means for stabilizing the cooling air curtain flowing along the goods compartment opening are designed such that the cooling air curtain is diverted in the direction of the goods compartment.

BRIEF DESCRIPTION OF THE DRAWINGS

The refrigerated shelf cabinet according to the invention as well as further developments of the same shall be elucidated in more detail hereinafter by way of the embodiments illustrated in FIGS. 1 and 3, showing schematic lateral sectional views of possible embodiments of the refrigerated shelf cabinet according to the invention, and prior art FIG. 2.

DETAILED DESCRIPTION

Figures 1, 1A, 1B:
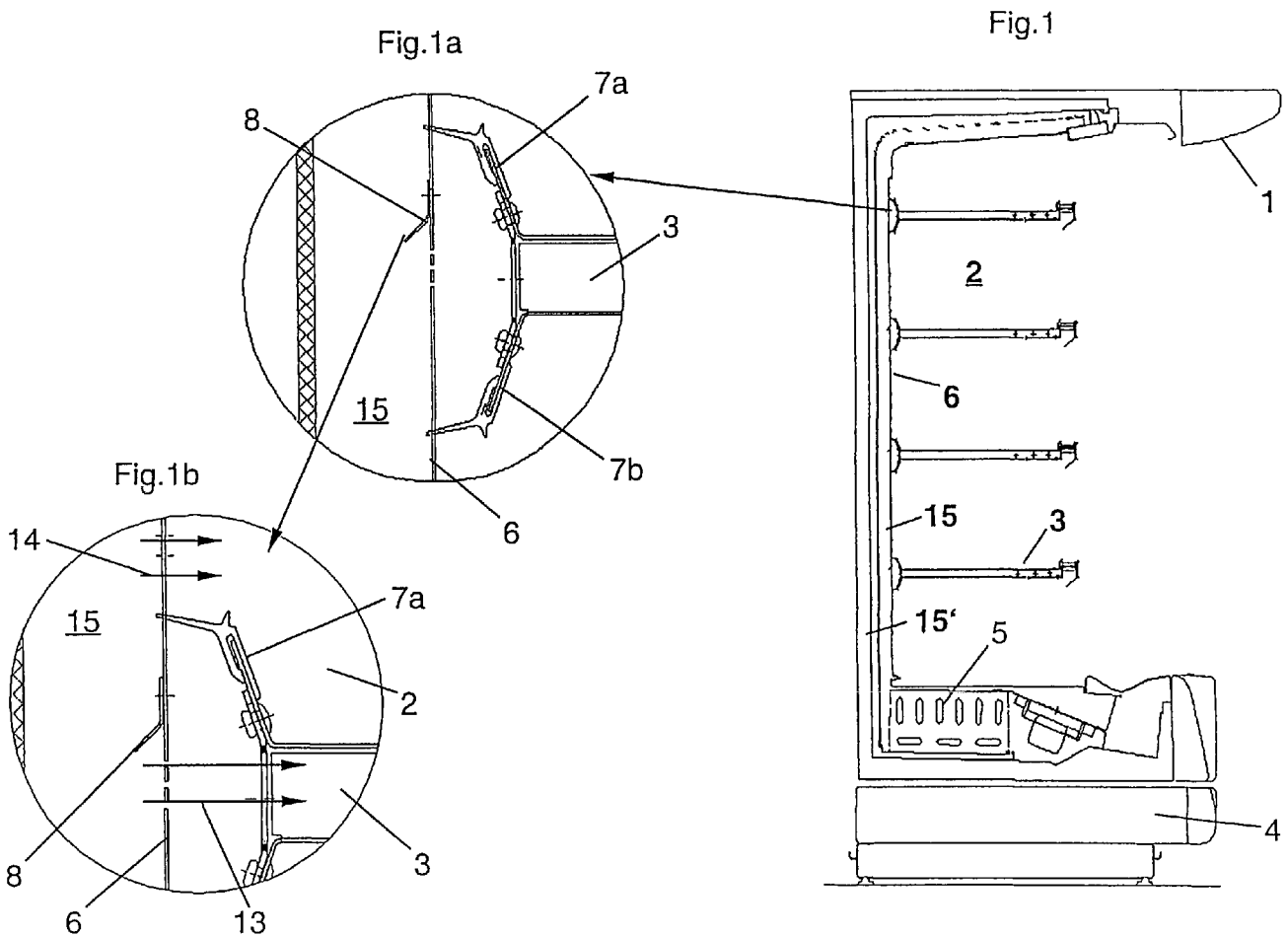
Figure 1:
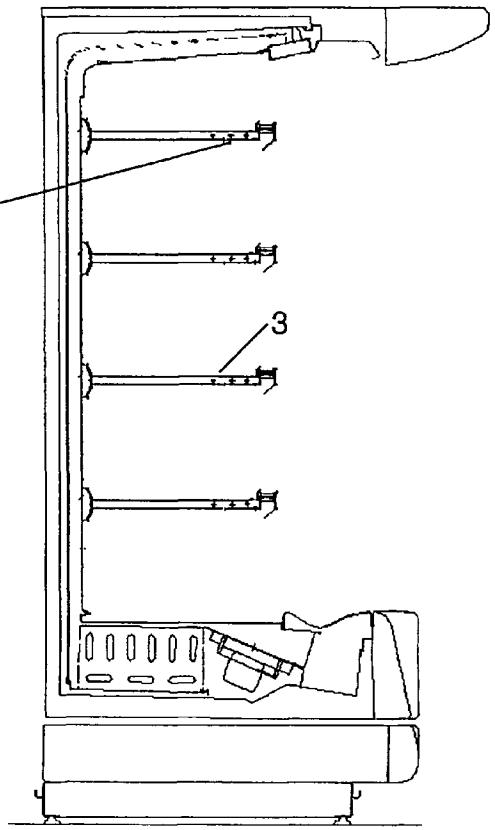

FIG. 1 illustrates a lateral sectional view of a refrigerated shelf cabinet 1, with the insulated base body, which surrounds the refrigerated goods compartment, resting on a pedestal 4. The refrigerated goods compartment 2 usually has a plurality of goods display shelves 3 arranged therein.

The units 5 required for generating the refrigerated air flow or flows as a rule are disposed underneath the lowermost goods display shelf; in FIG. 1, only a fan and an evaporator are illustrated for easier visibility.

The cooling air curtain entering via an opening arranged in the lower front portion of the refrigerated shelf cabinet is passed by means of the fan through the evaporator and is cooled in the same. Thereafter, the cooling air flow is passed via the air supply channel 15 to the air exit honeycomb member arranged in the upper front portion of the refrigerated shelf cabinet and is passed to the individual goods display shelves 3 via the at least partially perforated rear wall 6 of the goods compartment. In many cases—as in case of the refrigerated shelf cabinet illustrated in FIG. 1—there are provided two air supply channels 15 and 15', however, with cooling air entering from only one air supply channel 15 into the goods compartment 2 through the rear wall 6 of the same. A refrigerated shelf cabinet as illustrated in FIG. 1 can also be taken e.g. from the figure of the afore-mentioned German patent application 103 38 672.

FIG. 1*a* shows an enlarged fragment of FIG. 1. The figure shows the "transition region" between the air supply channel 15 confined by the goods compartment rear wall 6 and a good display shelf 3. According to the invention, the goods display shelves 3 now are joined to the goods compartment rear wall 6 in airtight manner.

As illustrated in FIG. 1*a*, this is achieved e.g. by providing two sealing lips 7*a* and 7*b*; the latter reliably prevent the discharge of cooling air flowing from the air supply channel 15 to the refrigerated goods compartment 2. By means of the sealing lips 7*a* and 7*b*, it is ensured that the entire partial flow of cooling air diverted from the air supply channel 15 into the goods display shelf 3 reaches said display shelf.

As an alternative to the sealing lips 7*a* and 7*b* described, it is possible to make use of arbitrary flexible sealing members, such as e.g. adhesive sealing tapes.

In accordance with a further development of the refrigerated shelf cabinet according to the invention, it is suggested to arrange a deflection means in the region of the airtight connection between the rear wall of the goods compartment and the goods display shelf, on the goods compartment rear wall side facing the air supply channel.

As shown in FIG. 1*b*—which again is an enlarged view of the fragment shown in FIG. 1*a*—the afore-mentioned deflection means may be in the form of a deflection metal sheet 8, for example. The deflection metal sheet 8 serves to optimize the speed of the cooling air flow discharged from the air supply channel 15 through the at least partially goods compartment rear wall 6 into the goods display shelf 3—as illustrated by arrows 13—and of the cooling air flow entering through the goods compartment rear wall 6 into the rear portion of the goods compartment 2—as illustrated by arrows 14.

The deflection means 8 preferably is designed such that the cooling air flow 13 entering from the air supply channel 15 into the goods display shelf 3 is subject to an increase in speed to approx. 0.7 to 1 m/s, whereas the cooling air flow 14 entering the rear portion of the goods compartment 2 from the air supply channel 15 is subject to a reduction in speed to approx. 0.1 to 0.5 m/s.

By way of a variety of deflection means 8, it is possible to realize a multiplicity of variations with respect to the quantitative distribution of the cooling air flows 13 and 14 as well as the speeds of the same.

Figure 1C:
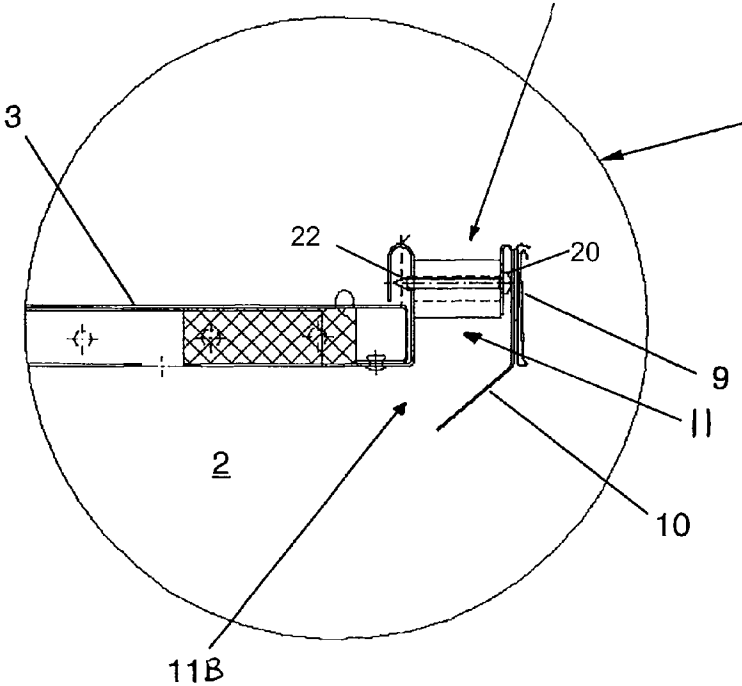

FIG. 1*c* illustrates a design of the inventive means for stabilizing the cooling air curtain flowing along the goods compartment opening, said means being designed such that the cooling air curtain is diverted towards the goods compartment 2.

As illustrated in FIG. 1*c*, this is realized by arranging a deflection metal sheet 10 underneath a price rail 9 in front of the goods display shelf 3 such that an air flow channel 11 is formed which diverts the cooling air flow 100 (FIG. 3), entering the flow channel 11 from the top (inlet at 11A), in the direction towards the refrigerated goods compartment 2 (exiting at 11B). The sheet 10 thus forms a lower portion of a front wall 20 of the channel with the price rail along an upper portion. The sheet 10 extends downward and rearward/inward back into the compartment. The rear wall 22 of the exemplary channel is formed along a forward portion of the main part of the shelf. The air flow 100 passes downward from above the shelf, then through that shelf s channel flow channel 11 and is directed back inward into the goods compartment to merge with the outward flow 102 (FIG. 3) passed forwardly/outwardly through that shelf from the rear air supply channel. The illustrated outward flow 102 exits forwardly from outlets along the underside of the associated shelf behind the channel 11.

Figure 3:
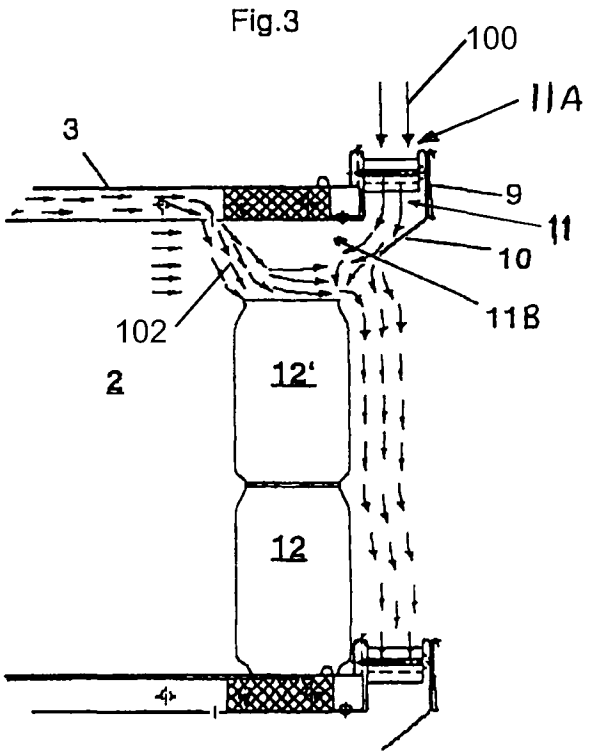
Figure 2:
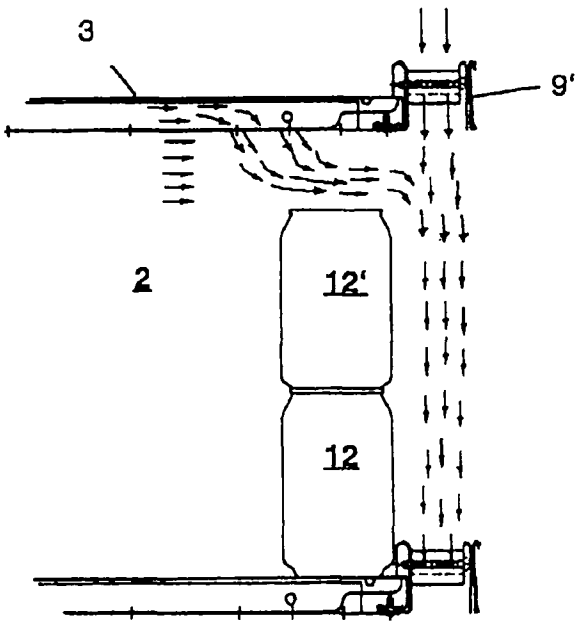
Fig.2 PRIOR ART

The advantages achieved thereby shall be elucidated in more detail by way of FIGS. 2 and 3.

FIG. 2 illustrates a solution as described e.g. in the initially mentioned German patent application 103 38 672. The cooling air flow or curtain flowing along the goods compartment opening in that event is stabilized only by the price rail 9' arranged in front of the goods display shelf 3. The result of this is that the cooling air flow flows only partially around the uppermost one of the two beverage cans 12 and 12'.

In case of the solution according to the invention, as illustrated in FIG. 3, the cooling air flow along the goods compartment opening now is diverted by means of the deflection metal sheet 10 and the air channel 11, respectively, so as to flow towards the refrigerated goods compartment 2 and thus towards the uppermost beverage can 12'. Thus, there is an optimum flow of the cooling air flow around beverage can 12' as well. The result hereof is that the beverage can 12', after a predetermined time of refrigeration, has a cooler temperature in case of the solution according to the invention illustrated in FIG. 3 as compared to the beverage can 12' subject to the solution illustrated by way of FIG. 2.

The refrigerated shelf cabinet according to the invention on the one hand permits purposeful tapping of a partial flow of the cooling air flow from the rear air supply channel 15 into the goods display shelves 3, resulting in optimum distribution of the amount of cooling air; on the other hand, the purposeful diversion at least of a partial flow of the cooling air curtain flowing along the goods compartment opening provides for an improved cooling effect of the goods arranged in the front portion of a goods display shelf 3 facing the customer.

The invention claimed is:

1. An at least partially refrigerated shelf cabinet that is open towards a frontal portion of the at least partially refrigerated shelf cabinet and in which refrigeration of a goods compartment is effected by means of a cooling air curtain flowing along a goods compartment opening, the goods compartment having one or more goods display shelves arranged therein which are designed such that a flow (13) for joining the cooling air curtain is passed through the one or more goods display shelves into a region of the forward front of the one or more goods display shelves, and with the one or more goods display shelves having means for stabilizing at least a partial flow of the cooling air curtain flowing along the goods compartment opening wherein a) the one or more goods display shelves (3) are joined to a goods compartment rear wall (6) in airtight fashion, and b) the means for stabilizing at least the partial flow of the cooling air curtain flowing along the goods compartment opening are designed such that the cooling air curtain is diverted in the direction of the goods compartment (2).

2. The at least partially refrigerated shelf cabinet that is open towards the front, according to claim 1, wherein the airtight connection between the goods compartment rear wall (6) and the one or more goods display shelves (3) is constituted by two flexible sealing members each arranged between the goods compartment rear wall (6) and each of the one or more goods display shelves (3).

3. The at least partially refrigerated shelf cabinet that is open towards the front, according to claim 2, characterized in that the flexible sealing members are in the form of adhesive sealing tapes or sealing lips (7*a*, 7*b*).

4. The at least partially refrigerated shelf cabinet that is open towards the front, according to claim 1, wherein the means for stabilizing at least the partial flow of the cooling air curtain flowing along the goods compartment opening are designed as air guiding channels (11) arranged in the region of the forward front of the goods display shelves (3).

5. The at least partially refrigerated shelf cabinet that is open towards the front, according to claim 1, wherein a deflection means (8) is arranged in the region of the airtight connection between the goods compartment rear wall (6) and goods presentation shelf (3), on a side of the goods compartment rear wall (6) facing an air supply channel (15).

6. The at least partially refrigerated shelf cabinet that is open towards the front, according to claim 1 characterized in that:

the means comprises air guiding channels (11) each at a front of an associated said goods display shelf (3) and having a deflector (10) at a front of the air guiding channel and positioned to direct the cooling air curtain flowing along the goods compartment opening and entering the air guiding channel from above the associated shelf inward in said direction of the goods compartment.

7. The at least partially refrigerated shelf cabinet that is open towards the front, according to claim 6, characterized in that the diverted air flow merges with said flow (13) for joining the cooling air curtain as said flow (13) exits forwardly from the associated shelf.

8. An at least partially refrigerated shelf cabinet that is open towards a frontal portion of the at least partially refrigerated shelf cabinet and in which refrigeration of a goods compartment is effected by means of a cooling air curtain flowing along a goods compartment opening, the goods compartment having one or more goods display shelves arranged therein which are designed such that at least a partial flow for joining the cooling air curtain is passed through the one or more goods display shelves into a region of the forward front of the one or more goods display shelves, and with the one or more goods display shelves having means for stabilizing at least a partial flow of the cooling air curtain flowing along the goods compartment opening, characterized in that:

a) the one or more goods display shelves (3) are joined to a goods compartment rear wall (6) in airtight fashion, and b) the means for stabilizing at least the partial flow of the cooling air curtain flowing along the goods compartment opening are designed such that an air flow channel (11) is formed which deflects the cooling air curtain flow entering the air flow channel (11) from above in the direction of the goods compartment (2).

9. The at least partially refrigerated shelf cabinet that is open towards the front, according to claim 8, characterized in that the airtight connection between goods compartment rear wall (6) and goods display shelves (3) is constituted by two flexible sealing members each arranged between goods compartment rear wall (6) and goods display shelf (3).

10. The at least partially refrigerated shelf cabinet that is open towards the front, according to claim 9, characterized in that the flexible sealing members are in the form of adhesive sealing tapes or sealing lips (7*a*, 7*b*).

11. The at least partially refrigerated shelf cabinet that is open towards the front, according to claim 9, characterized in that the means for stabilizing the cooling air curtain flowing along the goods compartment opening are designed as air guiding channels (11) arranged in the region of the forward front of the goods display shelves (3).

12. The at least partially refrigerated shelf cabinet that is open towards the front, according to claim 11, characterized in that a deflection means (8) is arranged in the region of the airtight connection between goods compartment rear wall (6) and goods presentation shelf (3), on the side of the goods compartment rear wall (6) facing the air supply channel (15).

13. The at least partially refrigerated shelf cabinet that is open towards the front, according to claim 8, characterized in that the means for stabilizing the cooling air curtain flowing along the goods compartment opening are designed as air guiding channels (11) arranged in the region of the forward front of the goods display shelves (3).

14. The at least partially refrigerated shelf cabinet that is open towards the front, according to claim 8, characterized in that a deflection means (8) is arranged in the region of the airtight connection between goods compartment rear wall (6) and goods presentation shelf (3), on the side of the goods compartment rear wall (6) facing the air supply channel (15).

15. The at least partially refrigerated shelf cabinet that is open towards the front, according to claim 8, characterized in that the means for stabilizing comprises a deflector (10) at a front of the shelf positioned to direct flow back into the goods compartment and towards product below the shelf.

16. The at least partially refrigerated shelf cabinet that is open towards the front, according to claim 15, characterized in that the deflector (10) is at a front of the air flow channel (11).

17. The at least partially refrigerated shelf cabinet that is open towards the front, according to claim 15, characterized in that the deflector (10) comprises a metal sheet at a front of the air flow channel (11).

18. The at least partially refrigerated shelf cabinet that is open towards the front, according to claim 15, characterized in that the deflector (10) comprises a metal sheet underneath a price rail (9) of the associated shelf.

19. The at least partially refrigerated shelf cabinet that is open towards the front, according to claim 8 wherein the means passes the air curtain flow downward from above the associated shelf and directs the air curtain flow back inward into the goods compartment to merge with said flow passed via that shelf, said flow passed via that shelf exiting forwardly from outlets along an underside of that shelf behind the associated air flow channel (11) of that shelf.

20. An at least partially refrigerated shelf cabinet that is open towards a frontal portion of the at least partially refrigerated shelf cabinet and in which refrigeration of a goods compartment is effected by a cooling air curtain flowing through an at least partially perforated rear wall of the goods compartment into the goods compartment and a cooling air curtain flowing along the goods compartment opening, wherein:

the goods compartment has one or more goods display shelves which are designed such that a flow (13) for joining the cooling air curtain is passed through the one or more goods display shelves into a region of the forward front of the one or more goods display shelves;

the one or more goods display shelves (3) are joined to a goods compartment rear wall (6) in airtight fashion; and the goods display shelves have an air flow channel (11) at a front of the shelf, the air flow channel positioned to receive the cooling air curtain flowing along the goods compartment opening thereabove; and a deflector (10) at a front of the air flow channel (11) and positioned to divert the cooling air curtain in the direction of the goods compartment (2) and towards product below the shelf, stabilizing the cooling air curtain flowing along the goods compartment opening, wherein:

the deflector (10) extends downward and rearward/inward back into the goods compartment, so as to divert the cooling air curtain to merge with said flow (13), said flow (13) passing forwardly after exiting the associated shelf of said one or more goods display shelves; and the channel (11) has a front wall (20) and a rear wall (22), the deflector (10) forming a lower portion of the front wall.

21. The at least partially refrigerated shelf cabinet that is open towards the front, according to claim 20, characterized in that the deflector (10) comprises a metal sheet underneath a price rail (9) of the associated shelf.

22. An at least partially refrigerated shelf cabinet that is open towards a frontal portion of the at least partially refrigerated shelf cabinet and in which refrigeration of a goods compartment is effected by means of a cooling air curtain flowing along a goods compartment opening, the goods compartment having one or more goods display shelves arranged therein which are designed such that at least a partial flow for joining the cooling air curtain is passed through the one or more goods display shelves into a region of a forward front of the one or more goods display shelves to merge with the cooling air curtain flow passing from above through an air flow channel (11) at the front of each of the shelves, the goods display shelves (3) joined to a goods compartment rear wall (6) in airtight fashion, further characterized by:

means (10) for stabilizing at least the partial flow of the cooling air curtain falling along the goods compartment opening by a deflecting inward toward the goods compartment the air curtain flow passing through the air flow channel (11), the air curtain entering a top of the channel and being deflected on exiting the air flow channel.

23. The at least partially refrigerated shelf cabinet as opened towards the front, according to claim 22 wherein:

each of a plurality of said one or more goods display shelves includes said means for stabilizing the cooling air curtain.

24. A refrigerated cabinet having:

a goods compartment;

an open front;

a rear wall having an air supply channel; and a plurality of goods display shelves (3), one above another and each including a passageway for passing air from the air supply channel; and a forward air flow channel (11) through which a cooling air curtain sequentially passes: entering after passing along the open front above the subject shelf to merge with the air passed through the passageway of the subject shelf, and exiting along the open front below the subject shelf, each shelf further comprising:

means (10) for stabilizing cooling air falling along the goods compartment opening by deflecting inward toward the goods compartment the cooling air curtain passing through the air flow channel of such shelf.

25. A refrigerated cabinet having:

a goods compartment;

an open front;

a rear wall having an air supply channel;

a plurality of goods display shelves (3), one above another and each including a passageway for passing air from the air supply channel; and a forward air flow channel (11) through which a cooling air curtain sequentially passes, entering after passing along the open front above the subject shelf to merge with the air passed through the passageway of the subject shelf, and exiting along the open front below the subject shelf, each shelf further comprising:

a deflector positioned to deflect inward toward the goods compartment the cooling air curtain passing through the air flow channel of such shelf.

* * * * *